US005941295A

United States Patent [19]

Sears, Jr.

[11] Patent Number: 5,941,295

[45] **Date of Patent: *Aug. 24, 1999**

[54] SYSTEM AND METHOD FOR REMOVING CRYSTALLIZED FLUX

[75] Inventor: James Bernard Sears, Jr., Cranberry Twp., Pa.

[73] Assignee: AG Industries, Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/724,132

[22] Filed: Sep. 30, 1996

[51] Int. Cl.[6] ..... B22D 11/07

[52] U.S. Cl. ..... 164/5; 164/472

[58] Field of Search ..... 164/5, 268, 472, 164/477, 417

[56] References Cited

U.S. PATENT DOCUMENTS 4,705,096 11/1987 Chia ..... 164/477

FOREIGN PATENT DOCUMENTS 60394 9/1982 European Pat. Off. ..... 164/5

2856536 10/1979 Germany ..... 164/5

4010963 10/1991 Germany ..... 164/477

2-304626 11/1990 Japan .

4-178249 6/1992 Japan ..... 164/472

1266678 10/1986 U.S.S.R. ..... 164/5

*Primary Examiner*—Kuang Y. Lin

*Attorney, Agent, or Firm*—Knoble & Yoshida LLC

[57] ABSTRACT

An improved continuous casting system and process involves the removal of mold flux from the outer surfaces of the cast strand after it is withdrawn from the continuous casting mold. This will increase the quality of the cast product, as well as reduce the production of corrosive steams and liquids that typically form as a byproduct of the mold flux downstream of the mold. It will also reduce costs that are associated with water treatment. In the preferred embodiment, the mold flux is loosened from the strand by the application of pressurized fluid, and the flux and excess fluid are then removed by suction. The removed flux is preferably dried and then stored in a collection space. Multiple collection spaces may be provided for storing different type of recovered flux. Also disclosed is a system and process of removing flux from the collection space and then premixing it in predetermined proportions with virgin mold flux for reintroduction to the mold.

5 Claims, 2 Drawing Sheets

SYSTEM AND METHOD FOR REMOVING CRYSTALLIZED FLUX

BACKGROUND OF THE INVENTION

1. Field of the Invention

This invention relates to systems and processes for continuously casting metallic materials such as steel. More specifically, this invention relates to a system and process for improving the continuous casting process by removing and/or recycling mold flux during operation.

2. Description of the Related Technology

In a conventional continuous-casting machine, liquid metal is continuously introduced into the upper end of an open-ended, water cooled, vertically oscillating mold. A casting or strand, which at this stage has only a thin solidified outer skin and a liquid core, emerges continuously from the lower end of the mold.

Typically, a powdered flux is added to the upper end of the mold in small, carefully regulated quantities of approximately one pound of flux per ton of steel that is being casted. The flux melts and covers the surface of the pool of liquid metal in the mold, and also may form a protective and lubricating layer between the solidifying skin of the casting and the mold wall. This flux, which is commonly termed "mold flux" or "mold powder" in the industry, is in effect a synthetic slag which floats on top of the molten metal, melts, works its way down in between the newly formed shell of the strand and the mold walls, and is drawn out the bottom of the mold with the cast product. It functions to thermally insulate the top surface of the molten metal, isolate the molten metal from atmospheric gases, absorb and dissolve nonmetallic inclusions that have floated up to the molten metal surface, lubricate the mold/strand interface surfaces and provide a controlled conductive transfer of heat from the strand to the mold.

Unfortunately, crystallized flux can be rolled into the surface of the cast product, severely downgrading the surface quality and contributing to downstream conditioning such as scarfing which is very costly to the steel producer. Some machine builders deliberately avoid using rollers directly below the mold for that reason, and instead use cast iron grid systems which can accelerate washing the crystallized flux away before the product reaches the first roller below that grid system. Using grids in turn drives up the operating cost of the machine through more frequent equipment changes because of the shorter life of the grid system as compared to that of a roller system.

Steam which is created immediately below the mold can be very corrosive due to reaction with various elements in the mold flux which can form hydrofluoric, carbonic, or other acids. The constant presence of these acids in the machine spray chamber can decrease the life expectancy of the machine through deterioration of such components as rolls, bearing housings, frame members, and even the main frame and support structures themselves. In severe cases it has been known to attack first zone grids in a very short time causing them to erode so badly in a single day that they no longer support the strand and a breakout occurs.

SUMMARY OF THE INVENTION

It is an object of this invention to prevent degradation of the continuous casting machine that might otherwise occur as a result of the acidic steam discussed above.

It is further an object of the invention to permit efficient removal of crystallized flux from the machine, which will decrease water treatment costs and keep the machine much cleaner, thus reducing segment clean-up costs. This will also eliminate occasional build-ups of flux that have been known to block the spray nozzles and cause product quality problems such as cracking.

It is yet further an object of the invention to permit recycling of some of the crystallized flux for reuse in the mold. This could potentially save the steelmaking industry millions of dollars a year. Ideally, the invention permits recovery of the flux before it can be contaminated by grease, oil, or other foreign substances found further down in the continuous casting machine.

In order to achieve the above and other aspects of the invention, an improved continuous casting system that is constructed according to a first aspect of the invention includes a mold that has a top opening, a bottom opening, and a casting passage defined therein, the mold being fabricated to receive molten metal and to remove heat from the molten metal so as to form a partially solidified cast strand that continuously emerges from the bottom opening; and a flux removal system for removing at least a portion of any mold flux that may be on an outer surface of the cast strand after it emerges from the mold, whereby degradation of the casting system as a result of used mold flux will be prevented.

According to a second aspect of the invention, an improved continuous casting process for manufacturing a cast strand of metallic material, includes steps of: introducing molten metal into a continuous casting mold of the type that comprises a top opening, a bottom opening and a casting passage; introducing a mold flux into the mold; withdrawing a cast strand of partially solidified metallic material from the bottom opening of the mold; and removing at least a portion of any mold flux that is on the cast strand after the cast strand is withdrawn from the mold.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
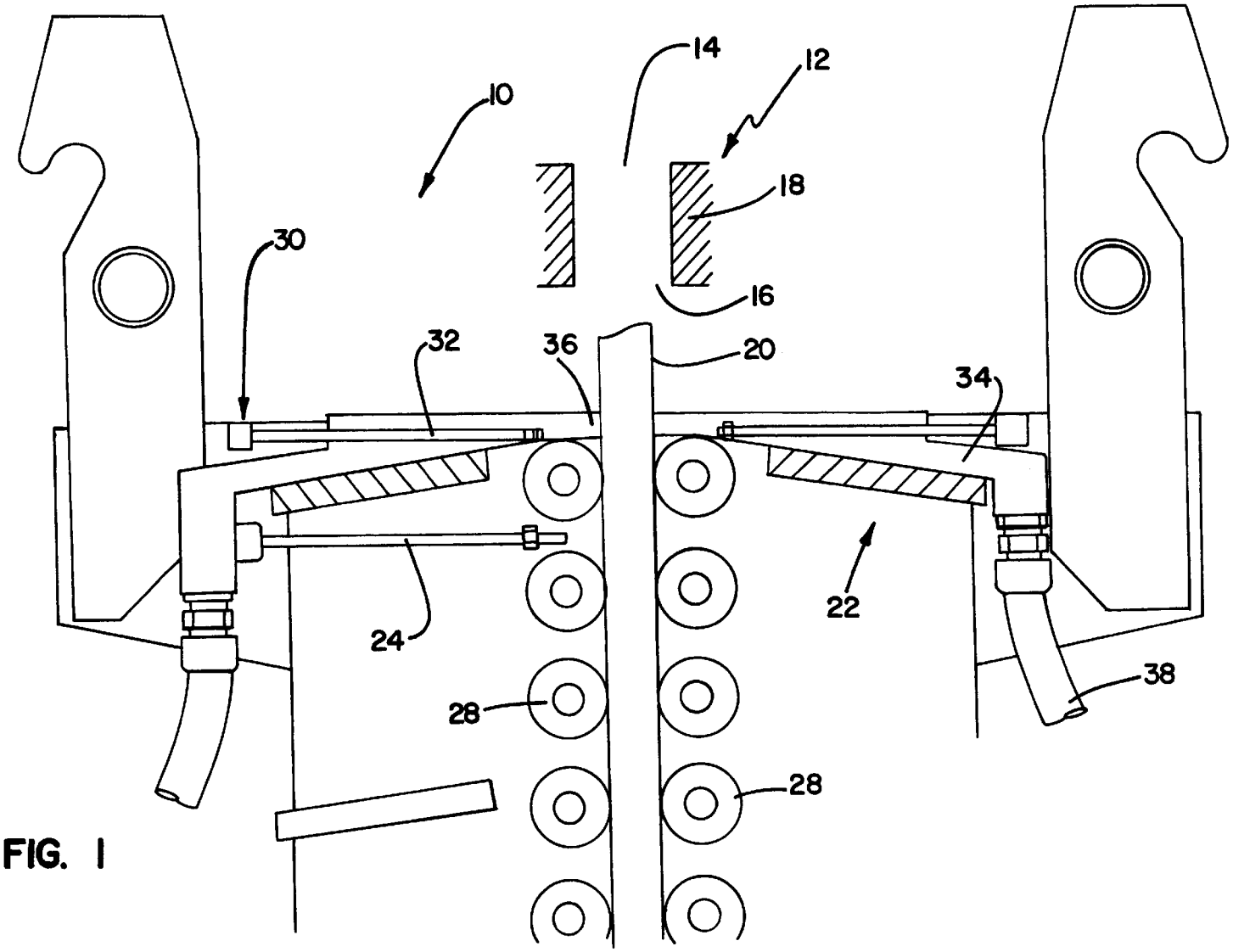
FIG. 1 is a partially schematic depiction of an improved continuous casting system that is constructed according to a preferred embodiment of the invention.

Referring now to the drawings, wherein like reference numerals designate corresponding structure throughout the views, and referring in particular to FIG. 1, an improved continuous casting system 10 that is constructed according to a preferred embodiment of the invention includes a mold 12, which is depicted schematically and is of conventional construction. Mold 12, as is typical, includes a top opening 14, a bottom opening 16, and a casting passage 18 defined therein, and is fabricated to receive molten metal and to remove heat from the molten metal so as to form a partially solidified cast strand 20 that continuously emerges from the bottom opening 16 during operation.

Also typical in continuous casting machines is the provision of a plurality of spray nozzles 24 downstream of the mold 12 for spraying water against and cooling the strand 20 as it continues to move downwardly away from the mold 12. A number of guide rolls 28 are provided in order to give lateral support to the cast strand 20, in order to insure that the cast strand 20 follows a predetermined path, and also to counter ferrostatic pressure that exists within the cast strand 20 until it is completely solidified.

Figure 2:
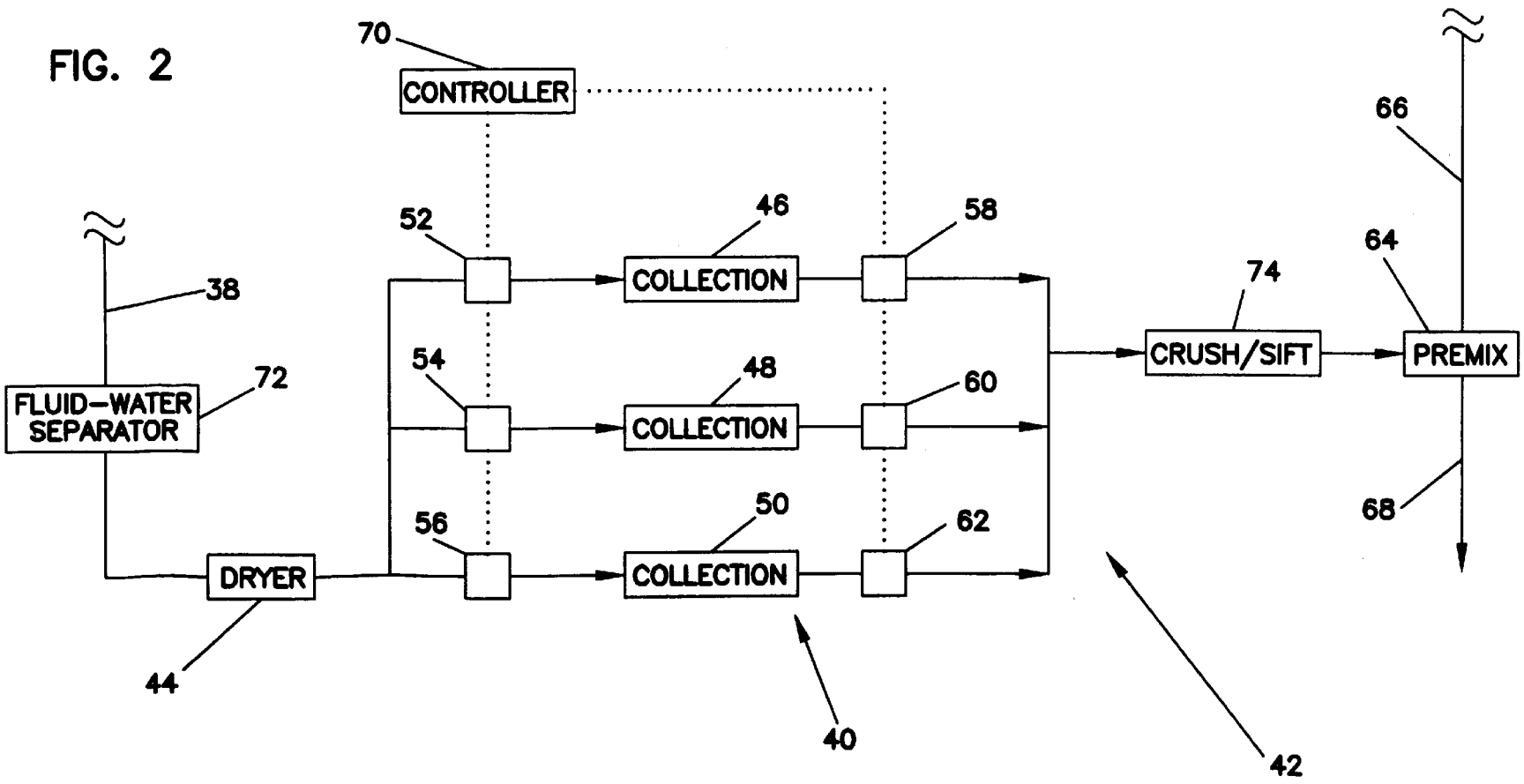
FIG. 2 is a schematic depiction of a different portion of the system that is illustrated in FIG. 1.

According to one novel aspect of the invention, the improved continuous casting system 10 that is depicted in FIGS. 1 and 2 includes a system 22 for removing at least a portion of any mold flux that may be on an outer surface of the cast strand 20 after it emerges from the mold 12. In the preferred embodiment, flux removal system 22 includes an agitator system 30 that is constructed and arranged to loosen mold flux from the strand 20 prior to its removal. In the illustrated preferred embodiment, agitator system 30 is embodied as one or more jet nozzles 32 that are positioned to apply a pressurized fluid to the outer surface of the cast strand 20. This fluid is preferably water, and may be made slightly alkaline to counteract the acidic nature of the mold flux and the steam that it produces when the water is applied to the still hot cast strand 20.

In addition to the agitator system 30, the flux removal system 22 advantageously preferably includes a system for applying suction to the outer surface of cast strand 20 in order to remove mold flux, including that which has been broken loose by action of the jet nozzles 32, from the cast strand 20. In the preferred embodiment, as is best shown in FIG. 1, flux removal system 22 includes a pair of vacuum plenums 34, each of which has an opening 36 that is immediately adjacent to one surface of the cast strand 20, and another end that is in communication with a vacuum conduit 38. Referring now to FIG. 2, it will be seen that vacuum conduit 38 leads to a system 40 for storing the mold flux, and ultimately to a system 42 for recycling the molt flux and remixing it with virgin flux for reintroduction to the mold 12. As may be seen in FIG. 2, the flux is preferably first passed through a fluid-water separator 72 and then a dryer mechanism 44 in order to remove fluid from the flux, and the dry flux is then transported by pneumatic pressure into the storage system 40. In the preferred embodiment, storage system 40 includes several different collection compartments each of which may be intended for collecting one type of flux. FIG. 2 depicts a first compartment 46, a second compartment 48, and a third compartment 50. Valves 52, 54 and 56 are interposed in the pneumatic conduit that lies between the drier mechanism 44 and the fist, second and third compartments 46, 48, 50, respectively. A controller 70 controls the operation of the valves 52, 54, 56. Similarly, valves 58, 60, 62 are interposed in the pneumatic conduits that connect the first, second and third compartments 46, 48, 50, respectively, with the recycling system 42. Valves 58, 60 and 62 are also controlled by the controller 70.

Recycling system 42 is embodied as a crushing/sifting mechanism 74 and a mixing mechanism 64 that is of conventional construction, which are connected so as to crush, sift and mix flux which is recovered from one or more of the storage compartments 46, 48, 50 with virgin, unused flux that is provided via a supply conduit 66. The recovered flux is mixed with the virgin flux in predetermined proportions, and the resulting mix may then be transported to the mold 12 for reuse via a pneumatic conduit 68. By making it possible to reuse even a small proportion of the mold flux, substantial cost savings may be realized by a metals manufacturer.

In operation, molten metal will be introduced into the mold 12 in through the top opening 14, and it will be transferred away from the molten metal by the mold 12, in a manner that is known to those in the industry. Simultaneously, mold flux will be introduced into the top opening 14 of the mold 12. As the metal in the mold 12 hardens forming a thin outer skin at a point in time prior to the emergence of cast strand 20 from the bottom opening 16 of the mold 12, the mold flux will loosely adhere itself to the outer surfaces of the cast strand 20. After the cast strand 20 emerges from the bottom opening 16 of the mold 12, the system 22 will loosen the mold flux from the cast strand 20 by subjecting the opposed wide surfaces of the cast strand 20 to pressurized fluid from the jet nozzles 32, shown in FIG. 1. Simultaneously, vacuum will be applied to the vacuum plenum 34, which causes the loosen mold flux, as well as the fluid that is applied from the jet nozzles 32 to be sucked into the vacuum plenum 34 through the respective openings 36, and into the vacuum conduit 38. The mold flux and fluid is then transported via the vacuum conduit 38 into the fluid-water separator 72 and the drier 44, where the fluid is separated from the mold flux. The dried mold flux is then transported to one of the compartments 46, 48, 50 in the storage system 40, the specific compartment being selected on the basis of the type of mold flux that is being used by the casting machine at this time. If the dried mold flux is to be collected in the first compartment 46, controller 70 will open valve 52, but close valves 54 and 56. If it is to be collected in the second compartment 48, controller 70 will open valve 54, but close valves 52 and 56. If the dried mold flux is to be collected in third compartment 50, controller 70 will instruct valves 52 and 54 to close, while opening valve 56.

In the event that recycling of the mold flux is desired, controller 70 will instruct valves 58, 60 or 62 to open, depending upon whether the type of flux desired is that stored in the first compartment 46, the second compartment 48, or the third compartment 50. The flux is then pneumatically transported to crush/sift mechanism and then to the mixture mechanism 64, and is mixed with virgin flux that is supplied to the mixer mechanism 64 by the supply conduit 66. The resulting mixture is then transported back to the mold 12 through the conduit 68.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved continuous casting process for manufacturing a cast strand of metallic material, comprising steps of:

(a) introducing molten metal into a continuous casting mold of the type that comprises a top opening, a bottom opening and a casting passage;

(b) introducing a mold flux into the mold;

(c) withdrawing a cast strand of partially solidified metallic material from the bottom opening of the mold; and (d) removing at least a portion of any crystallized mold flux that is on the cast strand after the cast strand is withdrawn from the mold, and wherein step (d) is performed by loosening crystallized mold flux from the strand by applying a pressurized fluid to the strand at a point of impingement, and then removing the loosened crystallized flux by suction, and wherein the point of impingement is no lower on the strand than where the suction is applied.

2. A method according to claim 1, further comprising a step of storing mold flux that is removed from the strand during step (d).

3. A method according to claim 2, wherein said storing step includes a step of selecting which of more than one compartment flux that is removed from the strand during step (d) will be directed to.

4. A method according to claim 2, further comprising a step of drying the mold flux before it is stored in said storage means.

5. A method according to claim 2, further comprising a step of removing flux from storage and premixing the previously stored flux with new flux for reintroduction into the mold.

* * * * *